US006309053B1

(12) United States Patent
Torgerson et al.

(10) Patent No.: US 6,309,053 B1
(45) Date of Patent: Oct. 30, 2001

(54) INK JET PRINTHEAD HAVING A GROUND BUS THAT OVERLAPS TRANSISTOR ACTIVE REGIONS

(75) Inventors: Joseph M. Torgerson, Philomath; David M. Hurst, Corvallis, both of OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/621,922

(22) Filed: Jul. 24, 2000

(51) Int. Cl.[7] ..... B41J 2/05

(52) U.S. Cl. ..... 347/59; 257/368; 257/379; 257/401; 257/201; 257/363; 257/208

(58) Field of Search ..... 257/368, 379, 257/363, 401, 208, 201; 347/50, 56, 58, 59

(56) References Cited

U.S. PATENT DOCUMENTS 5,182,577 * 1/1993 Ishinaga et al. ..... 347/58
5,774,147 * 6/1998 Saito et al. ..... 347/59
6,111,291 * 8/2000 Giebel ..... 257/339

FOREIGN PATENT DOCUMENTS 0769379 4/1997 (EP) .
0816082 6/1999 (EP) .

OTHER PUBLICATIONS

PCT International Search Report, PCT/US 01/02601, May 30, 2001.

* cited by examiner

*Primary Examiner*—John Barlow
*Assistant Examiner*—Ly Tran

(57) ABSTRACT

An ink jet printhead having a ground bus that partially overlies active regions of FET drive circuits.

17 Claims, 6 Drawing Sheets

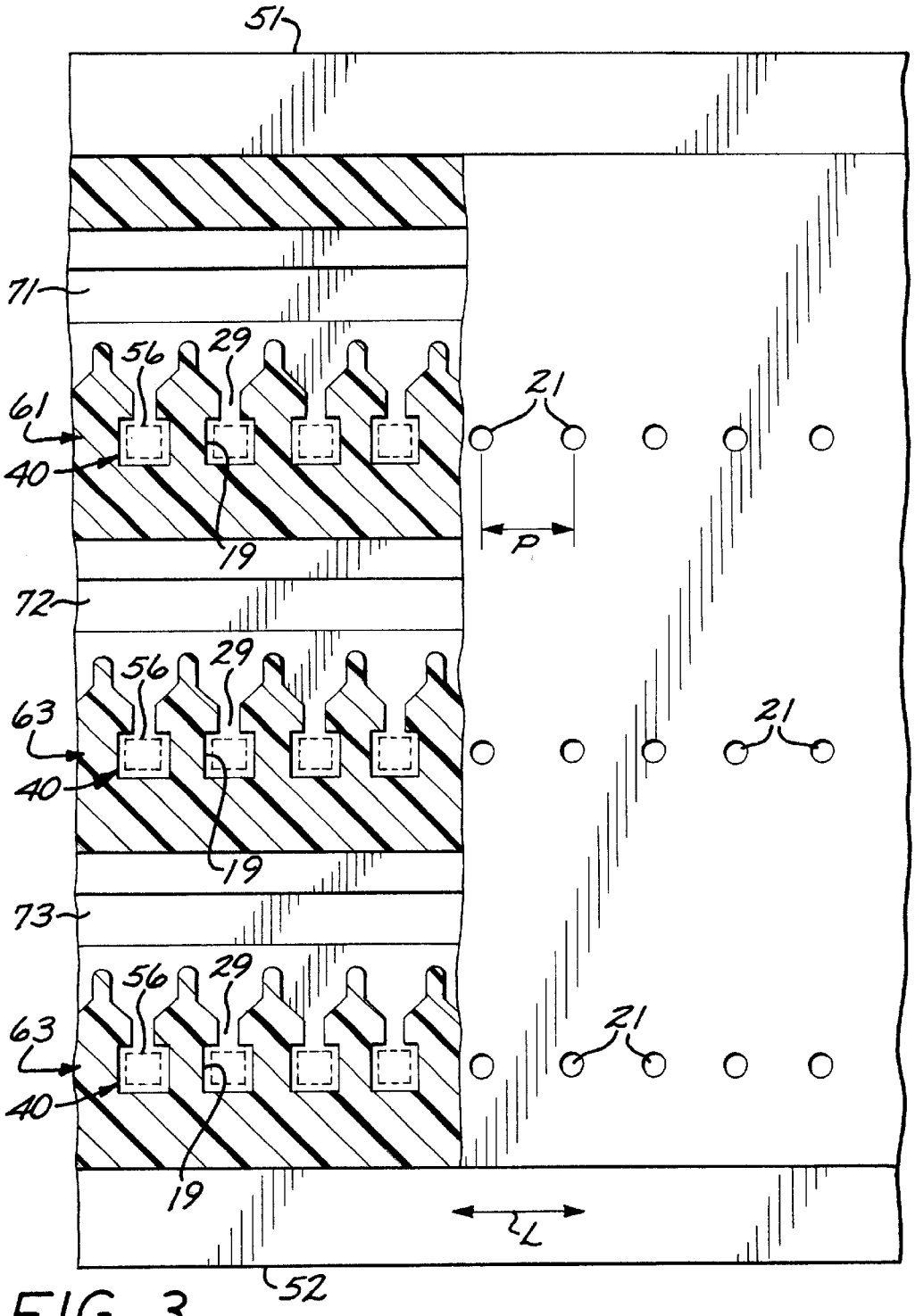
FIG. 3
FIG. 5
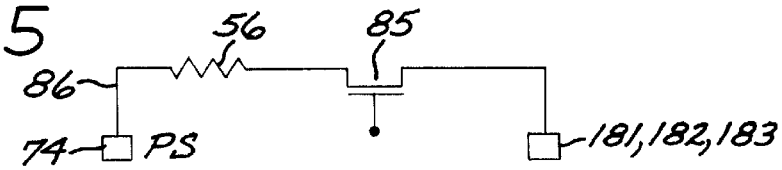

INK JET PRINTHEAD HAVING A GROUND BUS THAT OVERLAPS TRANSISTOR ACTIVE REGIONS

BACKGROUND OF THE INVENTION

The subject invention generally relates to ink jet printing, and more particularly to a thin film ink jet printhead having FET drive circuits configured to compensate for parasitic power dissipation along a ground bus.

The art of ink jet printing is relatively well developed. Commercial products such as computer printers, graphics plotters, and facsimile machines have been implemented with ink jet technology for producing printed media. The contributions of Hewlett-Packard Company to ink jet technology are described, for example, in various articles in the *Hewlett-Packard Journal*, Vol. 36, No. 5 (May 1985); Vol. 39, No. 5 (October 1988); Vol. 43, No. 4 (August 1992); Vol. 43, No. 6 (December 1992); and Vol. 45, No. 1 (February 1994); all incorporated herein by reference.

Generally, an ink jet image is formed pursuant to precise placement on a print medium of ink drops emitted by an ink drop generating device known as an ink jet printhead. Typically, an ink jet printhead is supported on a movable print carriage that traverses over the surface of the print medium and is controlled to eject drops of ink at appropriate times pursuant to command of a microcomputer or other controller, wherein the timing of the application of the ink drops is intended to correspond to a pattern of pixels of the image being printed.

A typical Hewlett-Packard ink jet printhead includes an array of precisely formed nozzles in an orifice plate that is attached to an ink barrier layer which in turn is attached to a thin film substructure that implements ink firing heater resistors and apparatus for enabling the resistors. The ink barrier layer defines ink channels including ink chambers disposed over associated ink firing resistors, and the nozzles in the orifice plate are aligned with associated ink chambers. Ink drop generator regions are formed by the ink chambers and portions of the thin film substructure and the orifice plate that are adjacent the ink chambers.

The thin film substructure is typically comprised of a substrate such as silicon on which are formed various thin film layers that form thin film ink firing resistors, apparatus for enabling the resistors, and also interconnections to bonding pads that are provided for external electrical connections to the printhead. The ink barrier layer is typically a polymer material that is laminated as a dry film to the thin film substructure, and is designed to be photodefinable and both UV and thermally curable. In an ink jet printhead of a slot feed design, ink is fed from one or more ink reservoirs to the various ink chambers through one or more ink feed slots formed in the substrate.

An example of the physical arrangement of the orifice plate, ink barrier layer, and thin film substructure is illustrated at page 44 of the *Hewlett-Packard Journal* of February 1994, cited above. Further examples of ink jet printheads are set forth in commonly assigned U.S. Pat. Nos. 4,719,477 and 5,317,346, both of which are incorporated herein by reference.

Considerations with thin film ink jet printheads include increased substrate size and/or substrate fragility as more ink drop generators and/or ink feed slots are employed. There is accordingly a need for an improved ink jet printhead that is compact and has a large number of ink drop generators.

SUMMARY OF THE INVENTION

The disclosed invention is directed to an ink jet printhead having a ground bus that partially overlies active regions of heater resistor energizing FET drive circuits.

BRIEF DESCRIPTION OF THE DRAWINGS

The advantages and features of the disclosed invention will readily be appreciated by persons skilled in the art from the following detailed description when read in conjunction with the drawing wherein:

FIG. 3 is an unscaled schematic partial top plan illustration of the ink jet printhead of FIG. 1.

FIG. 5 is an electrical circuit schematic depicting the electrical connections of a heater resistor and an FET drive circuit of the printhead of FIG. 1.

DETAILED DESCRIPTION OF THE DISCLOSURE

Figure 1:
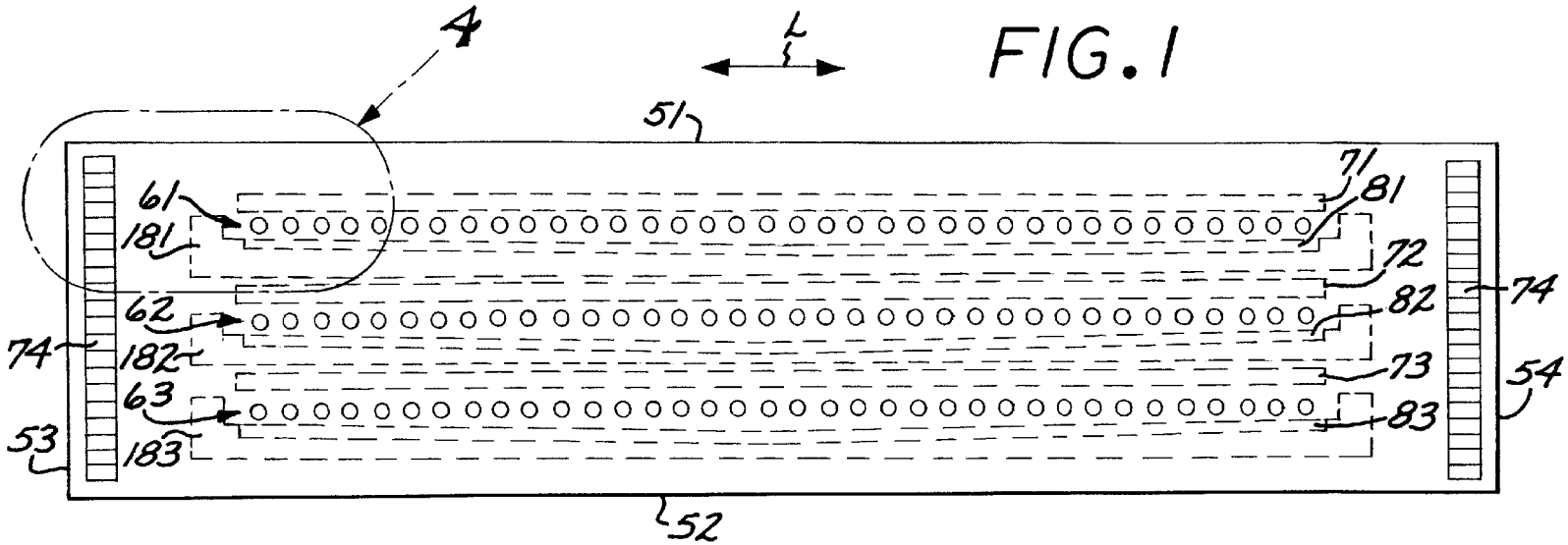
FIG. 1 is an unscaled schematic top plan view illustration of the layout of an ink jet printhead that employs the invention.
Figure 4:
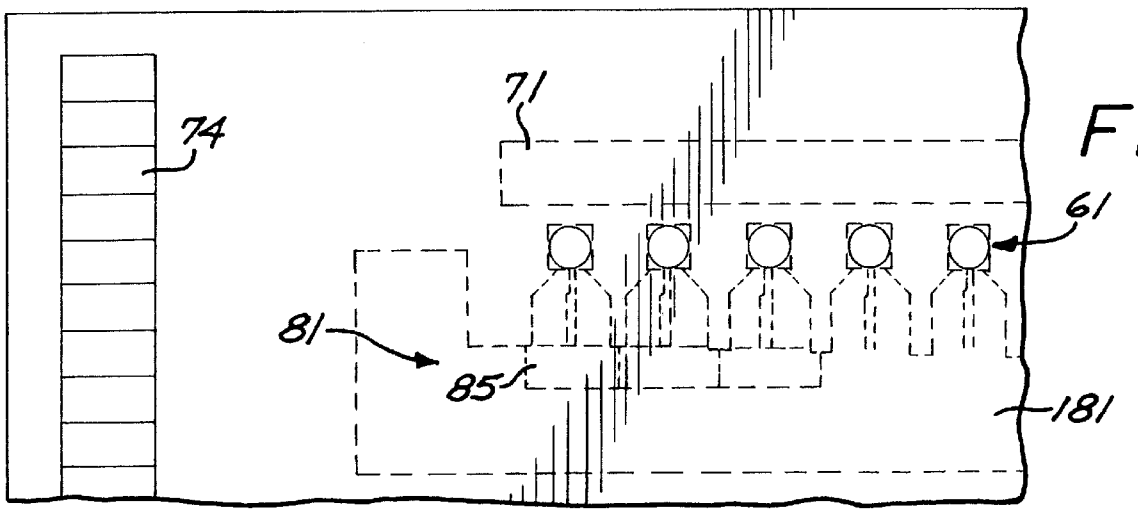
FIG. 4 is a partial top plan view generally illustrating the layout of an FET drive circuit array and an associated ground bus of the printhead of FIG. 1.

In the following detailed description and in the several figures of the drawing, like elements are identified with like reference numerals.

Figure 2:
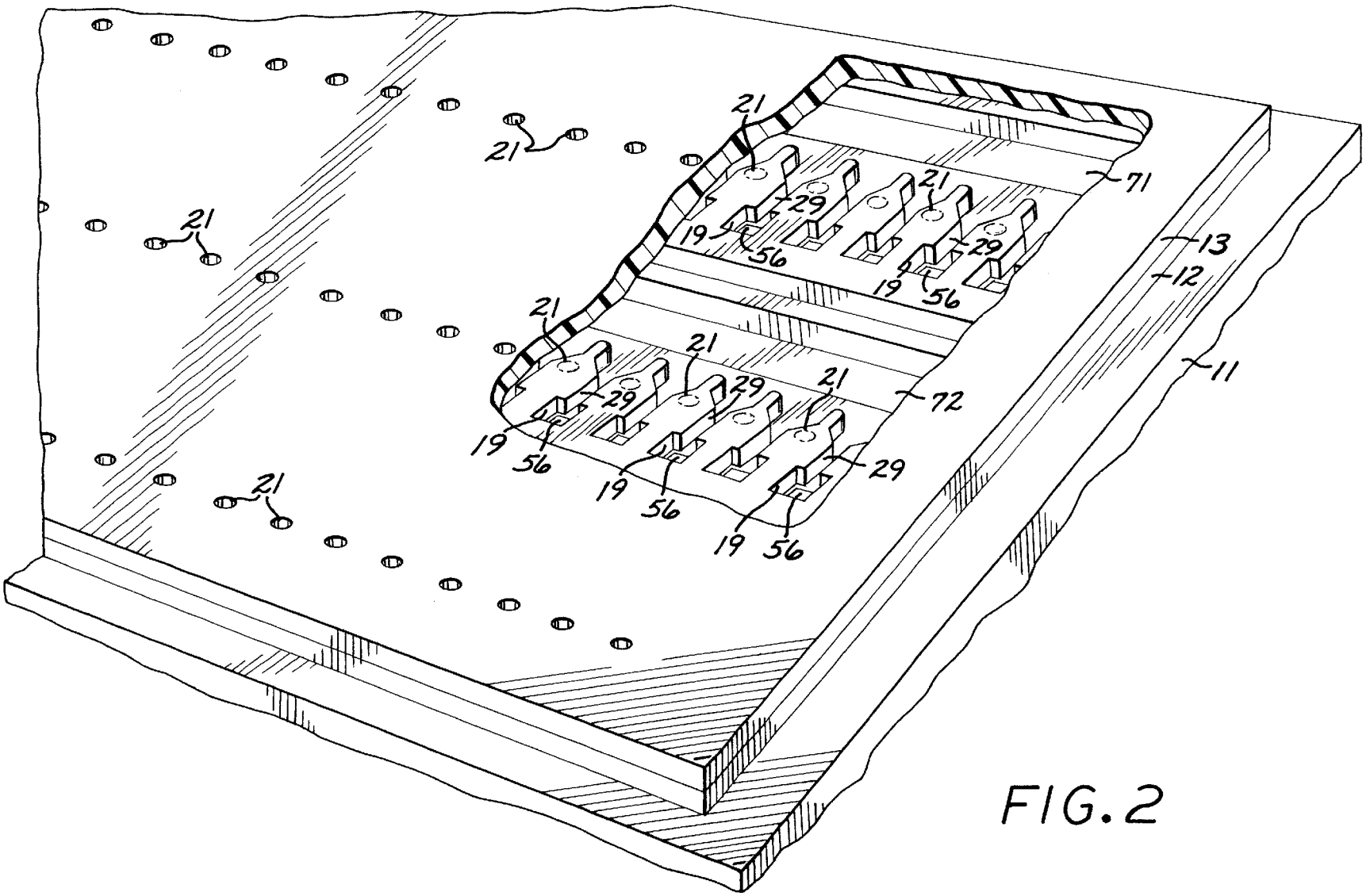
FIG. 2 is a schematic, partially broken away perspective view of the ink jet printhead of FIG. 1.

Referring now to FIGS. 1 and 2, schematically illustrated therein is an unscaled schematic perspective view of an ink jet printhead in which the invention can be employed and which generally includes (a) a thin film substructure or die 11 comprising a substrate such as silicon and having various thin film layers formed thereon, (b) an ink barrier layer 12 disposed on the thin film substructure 11, and (c) an orifice or nozzle plate 13 laminarly attached to the top of the ink barrier 12.

The thin film substructure 11 is formed pursuant to conventional integrated circuit techniques, and includes thin film heater resistors 56 formed therein. The ink barrier layer 12 is formed of a dry film that is heat and pressure laminated to the thin film substructure 11 and photodefined to form therein ink chambers 19 and ink channels 29 which are disposed over resistor regions in which the heater resistors are formed. Gold bonding pads 74 engagable for external electrical connections are disposed at longitudinally spaced apart, opposite ends of the thin film substructure 11 and are not covered by the ink barrier layer 12. By way of illustrative example, the barrier layer material comprises an acrylate based photopolymer dry film such as the "Parad" brand photopolymer dry film obtainable from E. I. duPont de Nemours and Company of Wilmington, Del. Similar dry films include other duPont products such as the "Riston" brand dry film and dry films made by other chemical providers. The orifice plate 13 comprises, for example, a planar substrate comprised of a polymer material and in which the orifices are formed by laser ablation, for example as disclosed in commonly assigned U.S. Pat. No. 5,469,199, incorporated herein by reference. The orifice plate can also comprise a plated metal such as nickel.

As depicted in FIG. 3, the ink chambers 19 in the ink barrier layer 12 are more particularly disposed over respective ink firing resistors 56, and each ink chamber 19 is defined by interconnected edges or walls of a chamber opening formed in the barrier layer 12. The ink channels 29 are defined by further openings formed in the barrier layer 12, and are integrally joined to respective ink firing chambers 19. FIGS. 1, 2 and 3 illustrate by way of example a slot fed ink jet printhead wherein the ink channels open towards an edge formed by an ink feed slot in the thin film substructure, whereby the edge of the ink feed slot forms a feed edge.

The orifice plate 13 includes orifices or nozzles 21 disposed over respective ink chambers 19, such that each ink firing resistor 56, an associated ink chamber 19, and an associated orifice 21 are aligned and form an ink drop generator 40.

While the disclosed printhead has been described as having a barrier layer and a separate orifice plate, it should be appreciated that the invention can be implemented in printheads having an integral barrier/orifice structure that can be made using a single photopolymer layer that is exposed with a multiple exposure process and then developed.

The ink drop generators 40 are arranged in three columnar arrays or groups 61, 62, 63 that are spaced apart from each other transversely relative to a reference axis L. The heater resistors 56 of each ink drop generator group are generally aligned with the reference axis L and have a predetermined center to center spacing or nozzle pitch P along the reference axis L. By way of illustrative example, the thin film substructure is rectangular and opposite edges 51, 52 thereof are longitudinal edges of the length dimension while longitudinally spaced apart, opposite edges 53, 54 are of the width dimension which is less than the length dimension of the printhead. The longitudinal extent of the thin film substructure is along the edges 51, 52 which can be parallel to the reference axis L. In use, the reference axis L can be aligned with what is generally referred to as the media advance axis.

While the ink drop generators 40 of each ink drop generator group are illustrated as being substantially collinear, it should be appreciated that some of the ink drop generators 40 of an ink drop generator group can be slightly off the center line of the column, for example to compensate for firing delays.

Insofar as each of the ink drop generators 40 includes a heater resistor 56, the heater resistors are accordingly arranged in groups or arrays that correspond to the ink drop generators. For convenience, the heater resistor arrays or groups will be referred to by the same reference numbers 61, 62, 63.

The thin film substructure 11 of the printhead of FIGS. 1, 2 and 3 more particularly includes ink feed slots 71, 72, 73 that are aligned with the reference axis L, and are spaced apart from each other transversely relative to a reference axis L. The ink feed slots 71, 72, 73 respectively feed the ink drop generator groups 61, 62, 63, and by way of illustrative example are located on the same side of the ink drop generator groups that they respectively feed. By way of illustrative example, each of the ink feed slots provides ink of a different color, such as cyan, yellow and magenta.

The thin film substructure 11 further includes drive transistor circuit arrays 81, 82, 83 formed in the thin film substructure 11 and located adjacent respective ink drop generator groups (61, 62, 63). Each drive circuit array (81, 82, 83) includes a plurality of FET drive circuits 85 connected to respective heater resistors 56. Associated with each drive circuit array (81, 82, 83) is a ground bus (181, 182, 183) to which the source terminals of all of the FET drive circuits 85 of the adjacent drive circuit array (81, 82, 83) are electrically connected. Each ground bus (181, 182, 183) is electrically interconnected to at least one bond pad 74 at one end of the printhead structure and to at least one contact pad 74 at the other end of the printhead structure.

As schematically shown in FIG. 5, the drain terminal of each FET circuit 85 is electrically connected to one terminal of the adjacent heater resistor 56 which receives at its other terminal an appropriate ink firing primitive select signal PS via a conductive trace 86 that is routed to a contact pad 74 at one end of the printhead structure. The conductive traces 86 comprise, for example, traces in a gold metallization layer that would be above and dielectrically separated from the metallization layer in which the ground busses 181, 182, 183 are formed. The conductive traces 56 are electrically connected to the heater resistors 56 by conductive vias and metal traces 57 (FIG. 6) formed in the same metallization layer as the ground busses 181, 182, 183. Also, the conductive trace 86 for a particular heater resistor can be generally routed to a bond pad 74 on the end that is closest to that heater resistor. Depending upon implementation, the heater resistors 56 of a particular ink drop generator group (61, 62, 63) can be arranged in a plurality of primitive groups, wherein the ink drop generators of a particular primitive are switchably coupled in parallel to the same ink firing primitive select signal, as for example disclosed in commonly assigned U.S. Pat. Nos. 5,604,519; 5,638,101; and 3,568,171, incorporated herein by reference. The source terminal of each of the FET drive circuits is electrically connected to an adjacent associated ground bus (181, 182, 183).

For ease of reference, the conductive traces including the conductive trace 86 and the ground bus that electrically connect a heater resistor 56 and an associated FET drive circuit 85 to bond pads 74 are collectively referred to as power traces. Also for ease of reference, the conductive traces 86 can be referred to as to the high side or non-grounded power traces.

Generally, the parasitic resistance (or on-resistance) of each of the FET drive circuits 85 is configured to compensate for the variation in the parasitic resistance presented to the different FET drive circuits 85 by the parasitic path formed by the power traces, so as to reduce the variation in the energy provided to the heater resistors. In particular, the power traces form a parasitic path that presents a parasitic resistance to the FET circuits that varies with location on the path, and the parasitic resistance of each of the FET drive circuits 85 is selected so that the combination of the parasitic resistance of each FET drive circuit 85 and the parasitic resistance of the power traces as presented to the FET drive circuit varies only slightly from one ink drop generator to another. Insofar as the heater resistors 56 are all of substantially the same resistance, the parasitic resistance of each FET drive circuit 85 is thus configured to compensate for the variation of the parasitic resistance of the associated power traces as presented to the different FET drive circuits 85. In this manner, to the extent that substantially equal energies are provided to the bond pads connected to the power traces, substantially equal energies can be provided to the different heater resistors 56.

Figure 6:
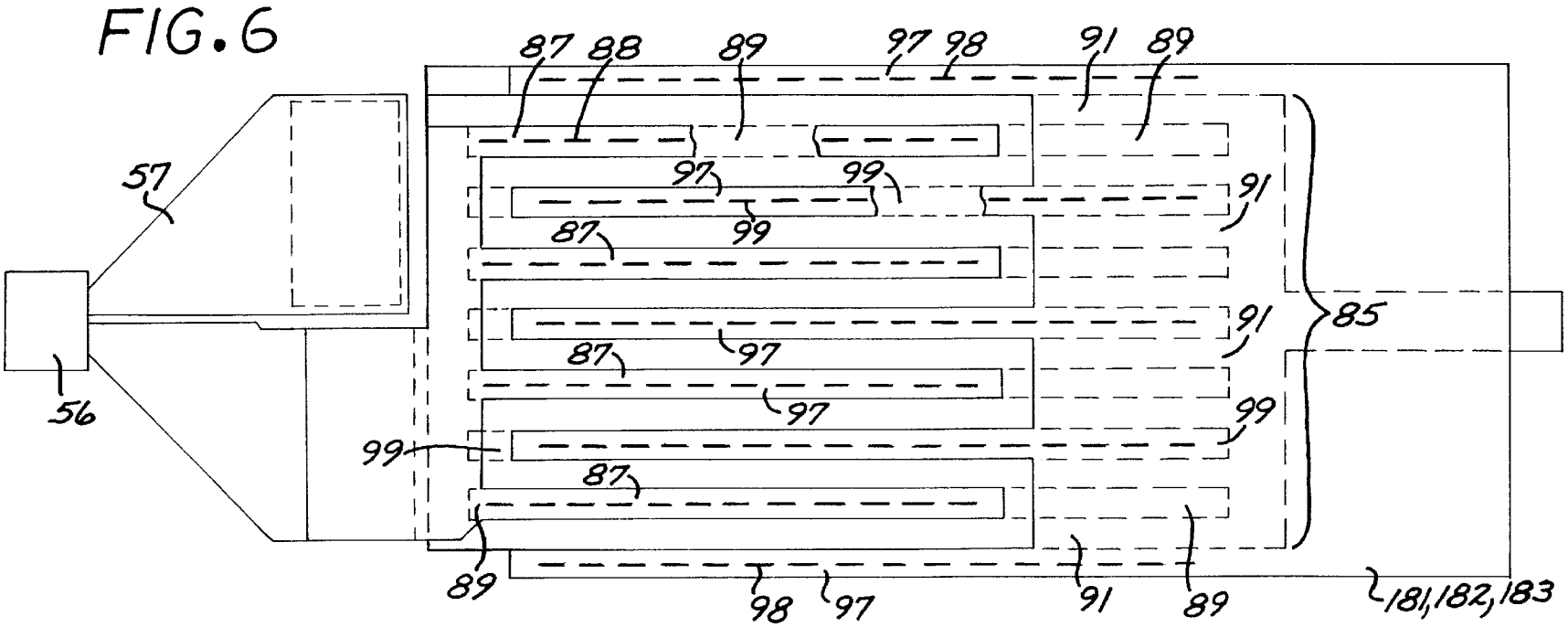
FIG. 6 is a plan view of representative FET drive circuits and the associated ground bus of the printhead of FIG. 1.
Figure 7:
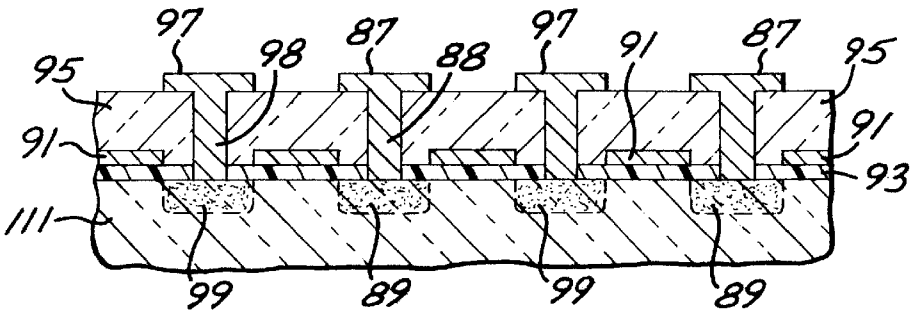
FIG. 7 is an elevational cross sectional view of a representative FET drive circuit of the printhead of FIG. 1.

Referring more particularly to FIGS. 6 and 7, each of the FET drive circuits 85 comprises a plurality of electrically interconnected drain electrode fingers 87 disposed over drain region fingers 89 formed in a silicon substrate 111, and a plurality of electrically interconnected source electrode fingers 97 interdigitated or interleaved with the drain electrodes 87 and disposed over source region fingers 99 formed in the silicon substrate 111. Polysilicon gate fingers 91 that are interconnected at respective ends are disposed on a thin gate oxide layer 93 formed on the silicon substrate 111. A phosphosilicate glass layer 95 separates the drain electrodes 87 and the source electrodes 97 from the silicon substrate 111. A plurality of conductive drain contacts 88 electrically connect the drain electrodes 87 to the drain regions 89, while a plurality of conductive source contacts 98 electrically connect the source electrodes 97 to the source regions 99. By way of illustrative example, the drain electrodes 87, drain regions 89, source electrodes 97, source regions 99, and the polysilicon gate fingers 91 extend substantially orthogonally or transversely to the reference axis L and to the longitudinal extent of the ground busses 181, 182, 183. Also, for each FET circuit 85, the extent of the drain regions 89 and the source regions 99 transversely to the reference axis L is the same as extent of the gate fingers transversely to the reference axis L, as shown in FIG. 6, which defines the extent of the active regions transversely to the reference axis L. For ease of reference, the extent of the drain electrode fingers 87, drain region fingers 89, source electrode fingers 97, source region fingers 99, and polysilicon gate fingers 91 can be referred to as the longitudinal extent of such elements insofar as such elements are long and narrow in a strip-like or finger-like manner.

By way of illustrative example, the on-resistance of each of the FET circuits 85 is individually configured by controlling the longitudinal extent or length of a continuously non-contacted segment of the drain region fingers, wherein a continuously non-contacted segment is devoid of electrical contacts 88. For example, the continuously non-contacted segments of the drain region fingers can begin at the ends of the drain regions 87 that are furthest from the heater resistor 56. The on-resistance of a particular FET circuit 85 increases with increasing length of the continuously non-contacted drain region finger segment, and such length is selected to determine the on-resistance of a particular FET circuit.

As another example, the on-resistance of each FET circuit 85 can be configured by selecting the size of the FET circuit. For example, the extent of an FET circuit transversely to the reference axis L can be selected to define the on-resistance.

For a typical implementation wherein the power traces for a particular FET circuit 85 are routed by reasonably direct paths to bond pads 74 on the closest of the longitudinally separated ends of the printhead structure, parasitic resistance increases with distance from the closest end of the printhead, and the on-resistance of the FET drive circuits 85 is decreased (making an FET circuit more efficient) with distance from such closest end, so as to offset the increase in power trace parasitic resistance. As a specific example, as to continuously non-contacted drain finger segments of the respective FET drive circuits 85 that start at the ends of the drain region fingers that are furthest from the heater resistors 86, the lengths of such segments are decreased with distance from the closest one of the longitudinally separated ends of the printhead structure.

Each ground bus (181, 182, 183) is formed of the same thin film conductive layer as the drain electrodes 87 and the source electrodes 97 of the FET circuits 85, and the active areas of each of the FET circuits comprised of the source and drain regions 89, 99 and the polysilicon gates 91 advantageously extend beneath an associated ground bus (181, 182, 183). This allows the ground bus and FET circuit arrays to occupy narrower regions which in turn allows for a narrower, and thus less costly, thin film substructure.

Also, in an implementation wherein the continuously non-contacted segments of the drain region fingers start at the ends of the drain region fingers that are furthest from the heater resistors 56, the extent of each ground bus (181, 182, 183) transversely or laterally to the reference axis L and toward the associated heater resistors 56 can be increased as the length of the continuously non-contacted drain finger sections is increased, since the drain electrodes do not need to extend over such continuously non-contacted drain finger sections. In other words, the width W of a ground bus (181, 182, 183) can be increased by increasing the amount by which the ground bus overlies the active regions of the FET drive circuits 85, depending upon the length of the continuously non-contacted drain region segments. This is achieved without increasing the width of the region occupied by a ground bus (181, 182, 183) and its associated FET drive circuit array (81, 82, 83) since the increase is achieved by increasing the amount of overlap between the ground bus and the active regions of the FET drive circuits 85. Effectively, at any particular FET circuit 85, the ground bus can overlap the active region transversely to the reference axis L by substantially the length of the non-contacted segments of the drain regions.

Figure 8:
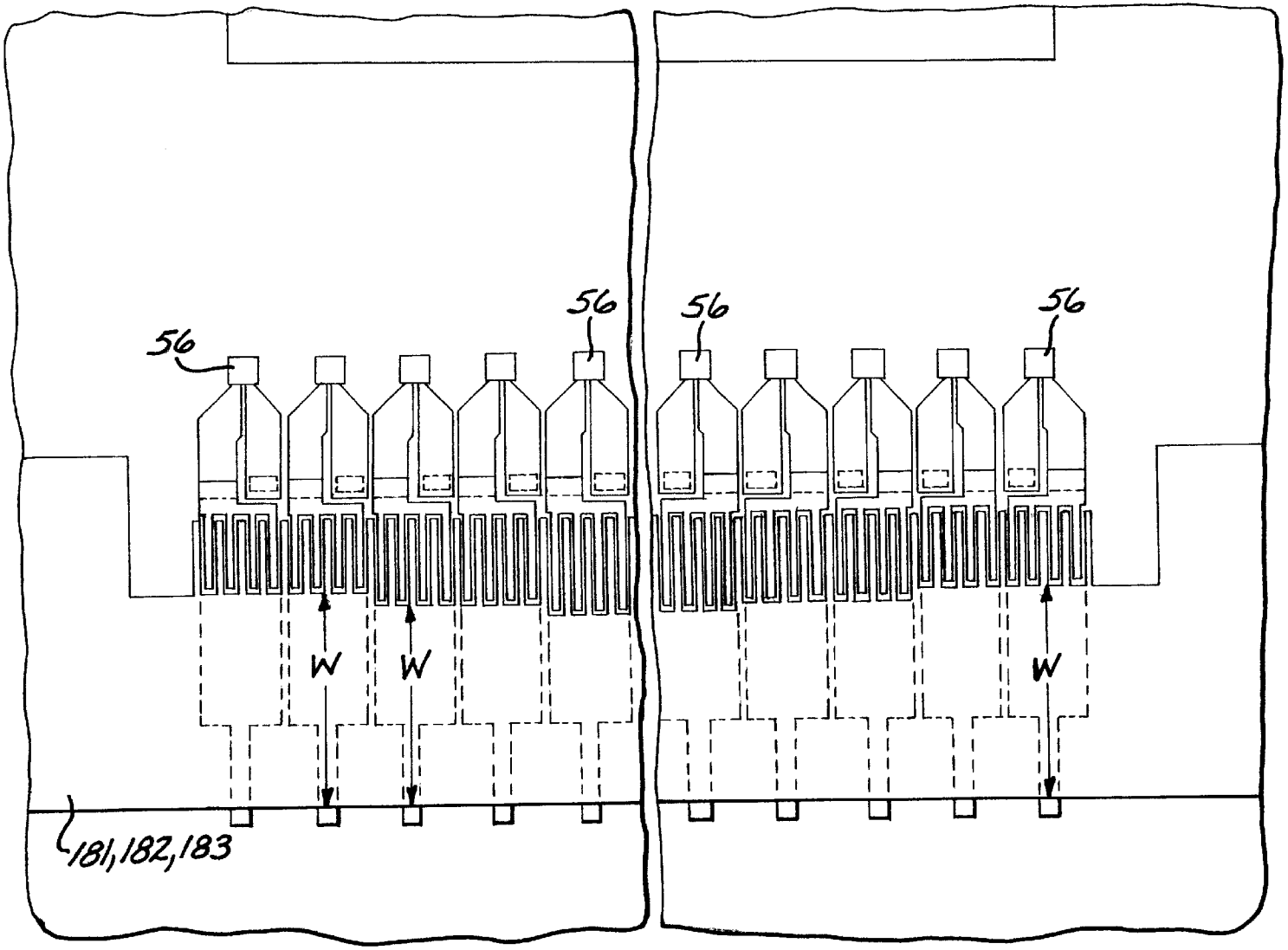
FIG. 8 is a plan view of plan view depicting an illustrative implementation of an FET drive circuit array and associated ground bus of the printhead of FIG. 1.

For the specific example wherein the continuously non-contacted drain region segments start at the ends of the drain region fingers that are furthest from the heater resistors 56 and wherein the lengths of such continuously non-contacted drain region segments decrease with distance from the closest end of the printhead structure, the modulation or variation of the width of a ground bus (181, 182, 183) with the variation of the length of the continuously non-contacted drain region segments provides for a ground bus having a width W that increases with proximity to the closest end of the printhead structure, as depicted in FIG. 8. Since the amount of shared currents increases with proximity to the bonds pads 74, such shape advantageously provides for decreased ground bus resistance with proximity to the bond pads 74.

While the foregoing has been directed to a printhead having three ink feed slots with ink drop generators disposed along only one side of an ink feed slot, it should be appreciated that the disclosed FET drive circuit array and ground bus structures can be implemented in variety of slot fed, edge fed, or combined slot and edge fed configurations. Also, ink drop generators can be disposed on one or both sides of an ink feed slot.

Referring now to FIG. 8, set forth therein is a schematic perspective view of an example of an ink jet printing device 110 in which the above described printheads can be employed. The ink jet printing device 110 of FIG. 7 includes a chassis 122 surrounded by a housing or enclosure 124, typically of a molded plastic material. The chassis 122 is formed for example of sheet metal and includes a vertical panel 122*a*. Sheets of print media are individually fed through a print zone 125 by an adaptive print media handling system 126 that includes a feed tray 128 for storing print media before printing. The print media may be any type of suitable printable sheet material such as paper, card-stock, transparencies, Mylar, and the like, but for convenience the illustrated embodiments described as using paper as the print medium. A series of conventional motor-driven rollers including a drive roller 129 driven by a stepper motor may be used to move print media from the feed tray 128 into the print zone 125. After printing, the drive roller 129 drives the printed sheet onto a pair of retractable output drying wing members 130 which are shown extended to receive a printed sheet. The wing members 130 hold the newly printed sheet for a short time above any previously printed sheets still drying in an output tray 132 before pivotally retracting to the sides, as shown by curved arrows 133, to drop the newly printed sheet into the output tray 132. The print media handling system may include a series of adjustment mechanisms for accommodating different sizes of print media, including letter, legal, A-4, envelopes, etc., such as a sliding length adjustment arm 134 and an envelope feed slot 135.

Figure 9:
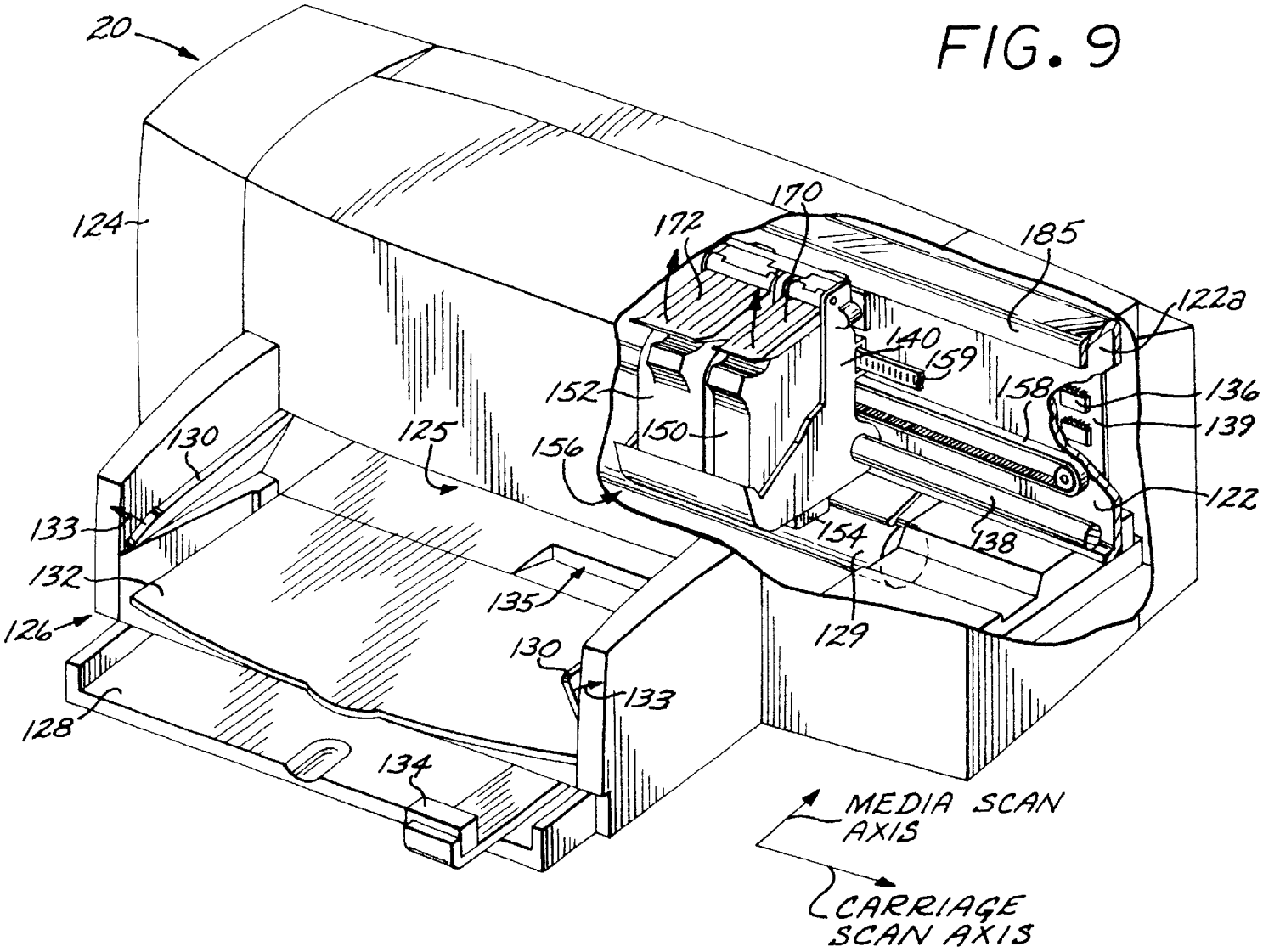
FIG. 9 is an unscaled schematic perspective view of a printer in which the printhead of the invention can be employed.

The printer of FIG. 9 further includes a printer controller 136, schematically illustrated as a microprocessor, disposed on a printed circuit board 139 supported on the rear side of the chassis vertical panel 122*a*. The printer controller 136 receives instructions from a host device such as a personal computer (not shown) and controls the operation of the printer including advance of print media through the print zone 125, movement of a print carriage 140, and application of signals to the ink drop generators 40.

A print carriage slider rod 138 having a longitudinal axis parallel to a carriage scan axis is supported by the chassis 122 to sizeably support a print carriage 140 for reciprocating transnational movement or scanning along the carriage scan axis. The print carriage 140 supports first and second removable ink jet printhead cartridges 150, 152 (each of which is sometimes called a "pen," "print cartridge," or "cartridge"). The print cartridges 150, 152 include respective printheads 154, 156 that respectively have generally downwardly facing nozzles for ejecting ink generally downwardly onto a portion of the print media that is in the print zone 125. The print cartridges 150, 152 are more particularly clamped in the print carriage 140 by a latch mechanism that includes clamping levers, latch members or lids 170, 172.

An illustrative example of a suitable print carriage is disclosed in commonly assigned U.S. application Ser. No. 08/757,009, filed Nov. 26, 1996, Harmon et al., incorporated herein by reference.

For reference, print media is advanced through the print zone 125 along a media axis which is parallel to the tangent to the portion of the print media that is beneath and traversed by the nozzles of the cartridges 150, 152. If the media axis and the carriage axis are located on the same plane, as shown in FIG. 9, they would be perpendicular to each other.

An anti-rotation mechanism on the back of the print carriage engages a horizontally disposed anti-pivot bar 185 that is formed integrally with the vertical panel 122*a* of the chassis 122, for example, to prevent forward pivoting of the print carriage 140 about the slider rod 138.

By way of illustrative example, the print cartridge 150 is a monochrome printing cartridge while the print cartridge 152 is a tri-color printing cartridge that employs a printhead in accordance with the teachings herein.

The print carriage 140 is driven along the slider rod 138 by an endless belt 158 which can be driven in a conventional manner, and a linear encoder strip 159 is utilized to detect position of the print carriage 140 along the carriage scan axis, for example in accordance with conventional techniques.

Although the foregoing has been a description and illustration of specific embodiments of the invention, various modifications and changes thereto can be made by persons skilled in the art without departing from the scope and spirit of the invention as defined by the following claims.

What is claimed is:

1. An ink jet printing apparatus comprising:

a printhead structure formed of a substrate and a plurality of thin film layers;

a columnar array of ink drop generators defined in said printhead structure;

a columnar array of FET circuits formed in said printhead structure and respectively connected to said ink drop generators, said FET circuits including active regions each comprised of drain regions, source regions, and a gate;

power traces including a ground bus electrically connected between (a) bond pads and (b) said ink drop generators and said FET circuits; and said ground bus generally extending along a longitudinal extent of said columnar array of FET circuits, and partially overlying said active regions.

2. The ink jet printing apparatus of claim 1 wherein said ground bus has a width transversely to the longitudinal extent of said columnar array of FET circuits that varies along said longitudinal extent.

3. The ink jet printing apparatus of claim 1 wherein said ground bus has a width transversely to the longitudinal extent of said columnar array of FET circuits that decreases with increasing distance from a closest one of longitudinally separated ends of said columnar array of FET circuits.

4. The ink jet printing apparatus of claim 1 wherein said drain regions, source regions and gate extend transversely to the longitudinal extent of said columnar array of FET circuits.

5. The ink jet printing apparatus of claim 1 wherein each of said FET circuits includes drain electrodes and source electrodes formed of a same metallization layer as said ground bus.

6. The ink jet printing apparatus of claim 1 wherein said FET circuits are respectively configured to compensate for variation in a parasitic resistance presented by said power traces.

7. The ink jet printing apparatus of claims 1 or 2 further including apparatus for imparting relative motion between said printhead structure and media on which ink drops are to be deposited by said ink drop generators.

8. An ink jet printing apparatus comprising:

a printhead structure formed of a substrate and a plurality of thin film layers, said print head structure having a longitudinal extent and longitudinally separated ends;

a longitudinal array of ink drop generators defined in said printhead structure and aligned with said printhead longitudinal extent;

a longitudinal array of FET circuits formed in said printhead structure adjacent said ink drop generators and aligned with said printhead longitudinal extent, said FET circuits respectively connected to said ink drop generators and including active regions each comprised of drain regions, source regions, and a gate;

bond pads disposed at said longitudinally separated ends;

power traces including a ground bus electrically connected between (a) said contact pads and (b) said ink drop generators and said FET circuits; and said ground bus generally extending along said printhead longitudinal extent and partially overlying said active regions.

9. The ink jet printing apparatus of claim 8 wherein said ground bus has a width transversely to the printhead longitudinal extent that varies along the printhead longitudinal extent.

10. The ink jet printing apparatus of claim 8 wherein said ground bus has a width transversely to the printhead longitudinal extent that decreases with increasing distance from a closest one of said longitudinally separated ends.

11. The ink jet printing apparatus of claim 8 wherein said drain regions, source regions and gate extend transversely to said printhead longitudinal extent.

12. The ink jet printing apparatus of claim 8 wherein each of said FET circuits includes drain electrodes and source electrodes formed of a same metal layer as said ground bus.

13. The ink jet printing apparatus of claim 8 wherein said FET circuits are respectively configured to compensate for variation in a parasitic resistance presented by said power traces.

14. An ink jet printing apparatus comprising:

a printhead structure formed of a substrate and a plurality of thin film layers;

an array of ink jet drop generators defined in said printhead structure;

an array of FET circuits formed in said printhead structure and respectively connected to said ink drop generators, said FET circuits including active regions each comprised of drain regions, source regions, and a gate;

power traces including a ground bus electrically connected between (a) bond pads and (b) said ink drop generators and said FET circuits; and said ground bus partially overlying said active regions.

15. The ink jet printing apparatus of claim 14 further including drain electrodes and source electrodes overlying said drain regions and said source regions.

16. The ink jet printing apparatus of claim 15 wherein said drain electrodes, said source electrodes, and said ground bus are formed of a same metallization layer.

17. The ink jet printing apparatus of claim 14 wherein said FET circuits are respectively configured to compensate for variation in a parasitic resistance presented by said power traces.

* * * * *

UNITED STATES PATENT AND TRADEMARK OFFICE

CERTIFICATE OF CORRECTION

PATENT NO. : 6,309,053 B1
DATED : October 30, 2001
INVENTOR(S) : Torgeson et al.

It is certified that error appears in the above-identified patent and that said Letters Patent is hereby corrected as shown below:

Title page,
Item [57], ABSTRACT, "An ink jet printhead having a ground bus that partially overlies active regions of FET drive circuits." should read -- An ink jet printhead having a ground bus that partially overlies active region of FET drive circuits. The thin film ink jet printhead having FET drive circuits configured to compensate for parasitic power dissipation along a ground bus. --

Item [56], References Cited, U.S. PATENT DOCUMENTS, add the following:

-- 5,984,464 * 11/1999 Steinfield, et al....347/87;
6,183,078 B1 * 2/2001 Pietrzyk, et al.....347/92;
6,286,924 B1 * 9/2001 Ahne, et al….347/10;
6,309,053 B1 * 10/2001 Torgerson, et al….347/59;
5,563,642 * 10/1996 Keefe, et a1...347/84;
5,568,171 * 10/1996 Keefe, et al....347/56;
5,594,481 * 1/1997 Keefe, et al....347/65;
5,604,519 * 2/1997 Keefe, et al....347/13;
5,619,236 * 4/1997 Keefe, et al....347/84;
5,638,101 * 6/1997 Keefe, et al....347/65;
5,648,804 * 7/1997 Keefe, et al....347/47;
5,648,805 * 7/1997 Keefe, et al....347/65;
5,648,806 * 7/1997 Steinfield, et al....347/87;
5,874,974 2/1999 Courian, et al....347/65;
5,946,012 * 8/1999 Courian, et al….347/63 --

Signed and Sealed this

Third Day of June, 2003

JAMES E. ROGAN
*Director of the United States Patent and Trademark Office*